US007467828B2

(12) United States Patent
Boucherie

(10) Patent No.: US 7,467,828 B2
(45) Date of Patent: Dec. 23, 2008

(54) DEVICE FOR MANUFACTURING BRUSHES

(75) Inventor: Bart Gerard Boucherie, Izegem (BE)

(73) Assignee: Firma G.B. Boucherie, Naamloze Vennootschap, Izegem (BE)

( * ) Notice: Subject to any disclaimer, the term of this patent is extended or adjusted under 35 U.S.C. 154(b) by 699 days.

(21) Appl. No.: 11/039,826

(22) Filed: Jan. 24, 2005

(65) Prior Publication Data

US 2005/0168049 A1 Aug. 4, 2005

(30) Foreign Application Priority Data

Feb. 4, 2004 (BE) ..... 2004/0058

(51) Int. Cl.
*A46D 3/00* (2006.01)

(52) U.S. Cl. ..... 300/2; 300/11

(58) Field of Classification Search ..... 300/2–3, 300/10–11, 21; 29/563–38.9
See application file for complete search history.

(56) References Cited

U.S. PATENT DOCUMENTS 3,261,644 A 7/1966 Smith
3,355,216 A 11/1967 Zahoransky
4,768,837 A * 9/1988 Boucherie ..... 300/4
4,854,645 A * 8/1989 Boucherie ..... 300/10

FOREIGN PATENT DOCUMENTS

GB 1 599 249 9/1981

* cited by examiner

*Primary Examiner*—Laura C Guidotti
(74) *Attorney, Agent, or Firm*—Bacon & Thomas, PLLC

(57) ABSTRACT

Device for manufacturing brushes by means of successive operations, which mainly consists of a number of brush holders (9-11) which are provided on a means of transport and which can be moved between different posts (5-8) which are provided along the means of transport, more particularly working posts (6-8) where a processing can take place and/or waiting posts (5) where the brush holders (9-11) can be put in a wait position, characterized in that the means of transport is provided with means which make it possible to move the brush holders (9-11) independently from one another.

11 Claims, 2 Drawing Sheets

DEVICE FOR MANUFACTURING BRUSHES

BACKGROUND OF THE INVENTION

1. Field of the Invention

The present invention concerns a device for manufacturing brushes, more particularly a device which consists of a means of transport; one or several tools which are erected along the means of transport; and brush holders which are provided on the means of transport.

In such devices, the brush bodies to be processed are fixed in the brush holders, and these brush bodies are successively positioned, with the help of the means of transport, opposite the different posts where the brush bodies are either or not subjected to a processing.

2. Discussion of the Related Art

Until now, it was usual to apply a carrousel or a chain as a means of transport, whereby usually five posts or stations are provided along a chain, whereas along the perimeter of a carrousel, depending on the type, maximally three or four posts or stations can be provided.

A first type of carrousel is what is called the triangular carrousel, around which maximally three posts are provided. In the most current known devices these posts are working posts, more particularly a loading and unloading post, where the brush bodies to be processed are fixed to the above-mentioned brush holders and where the finished brush bodies, after their processing, are removed from the brush holders again; a working post is provided with a drilling tool for making holes in the brush bodies; and a working post is provided with a filling tool for applying bundles of fibers in the above-mentioned holes.

The second type is what is called a square carrousel, around which maximally four posts can be provided. They usually comprise a loading and unloading tool; a working post with a drilling tool; a working post with a filling tool; and a working post with a cutting tool to cut the above-mentioned bundles of fibers at length.

A disadvantage of the known devices is that they can hardly or not at all be transformed from the one above-mentioned type into the other type, as the construction of a square carrousel differs strongly from that of a triangular carrousel, whereby moreover the angles differ over which said carrousels have to be turned between two posts.

Indeed, a triangular carrousel always turns at an angle of 120°, whereas a square carrousel has to be rotated 90° in between two working steps, which implies that the posts along the perimeter of both carrousels are provided at different positions.

Another disadvantage is that, in order to manufacture brushes with a device in which is provided a carrousel, along whose perimeter can be provided more posts than necessary for manufacturing the brushes concerned, one usually has to fix as many brush holders at the perimeter as the maximum number of posts that can be erected around the carrousel.

Indeed, when for example one of the four brush holders is removed from a square carrousel, the known device will lose one fourth of its productive capacity.

The latter disadvantage is also the most important one when using a known device, whereby a chain is applied as a means of transport.

The present invention aims to remedy the above-mentioned and other disadvantages.

SUMMARY OF THE INVENTION

To this end, the invention concerns a device for manufacturing brushes by means of successive operations, which mainly consists of a number of brush holders which are provided on a means of transport and which can be moved between different posts provided along the means of transport, more particularly working posts where a processing can take place, and/or waiting posts where the brush holders can be put in a wait position, whereby the means of transport is provided with means which make it possible to move the brush holders independently.

An advantage of the device according to the invention is that not all the brush holders have to be moved simultaneously over a same distance by the means of transport.

Thus, it becomes possible to lock one or several brush holders opposite a post concerned, whereas the other brush holders are moved to a subsequent post with the help of the means of transport in the meantime.

An advantage thereof is that, when a device according to the invention is used for manufacturing brushes which can be manufactured with a number of processing operations that is smaller than the maximum number of posts which can be erected along the means of transport, also the number of brush holders which are provided on the means of transport can be limited, without restricting the productive capacity of the device.

BRIEF DESCRIPTION OF THE DRAWINGS

In order to better explain the characteristics of the invention, the following preferred embodiments of a device according to the invention for manufacturing brushes are described as an example only without being limitative in any way, with reference to the accompanying drawings, in which.

DESCRIPTION OF SOME PREFERED EMBODIMENTS

Figure 1:
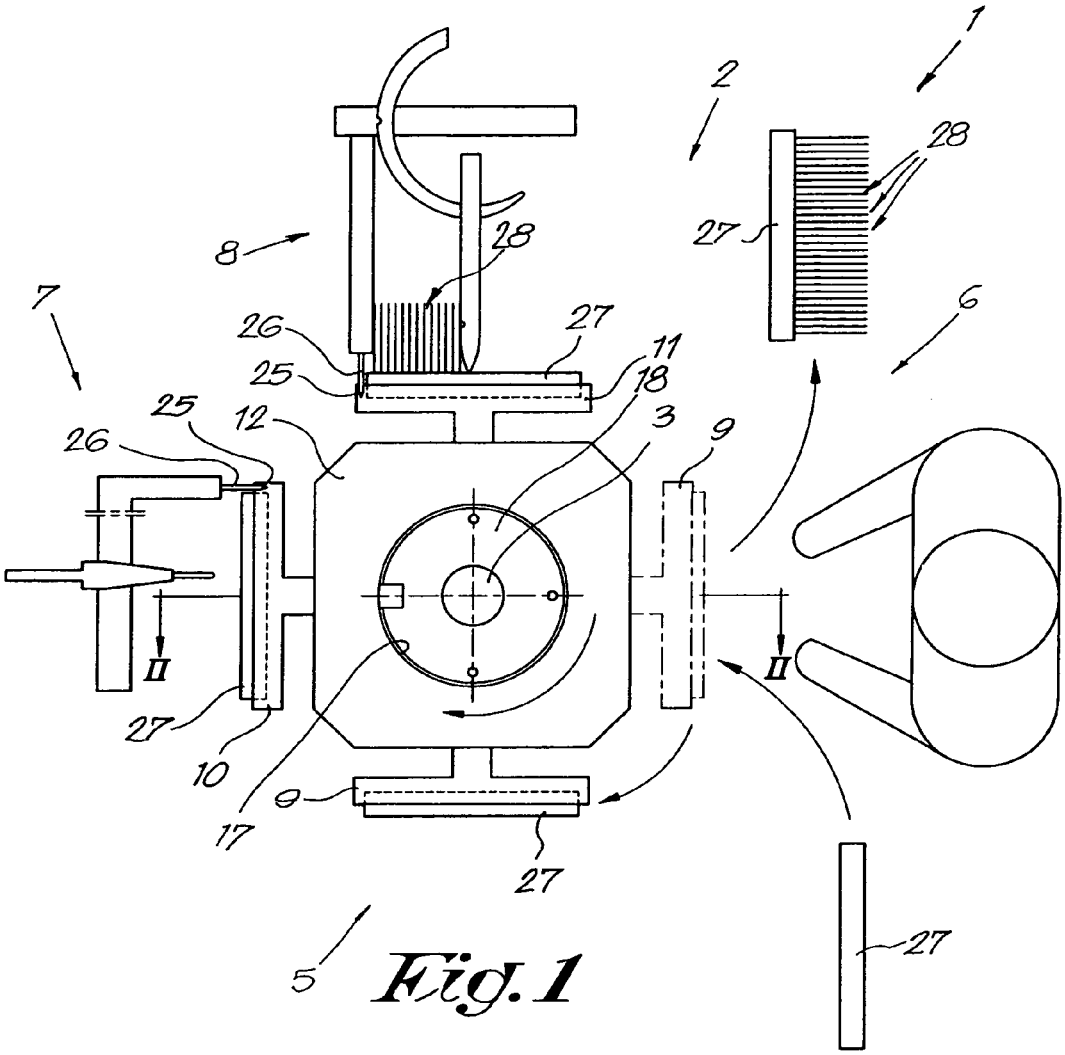
FIG. 1 schematically represents a view of a device according to the invention.
Figure 2:
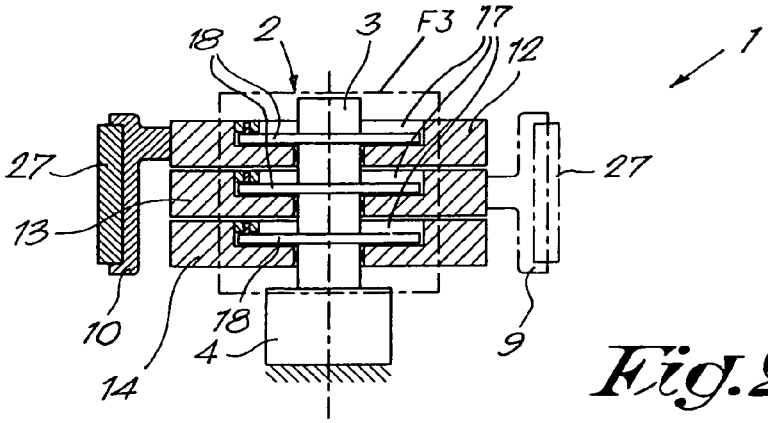
FIG. 2 represents a section according to line II-II in FIG. 1.

FIGS. 1 and 2 schematically represent a device 1 according to the invention which, in this case, mainly consists of a means of transport, in this case what is called a square carrousel 2 which can rotate around a shaft 3 which is provided with a drive 4, and of for example one waiting post 5 and three working posts 6-8 which are provided along the perimeter of the carrousel 2.

The working posts 6-8 are in this case a loading and unloading tool 6 and two posts 7-8 which are provided with a tool, a known drilling tool and a known filling tool respectively.

On the perimeter of the carrousel 2 are in this case provided three brush holders 9 to 11, whereby, according to the invention, the carrousel 2 comprises means which make it possible to rotate the different brush holders 9-11 independently from one another with the carrousel 2.

Figure 3:
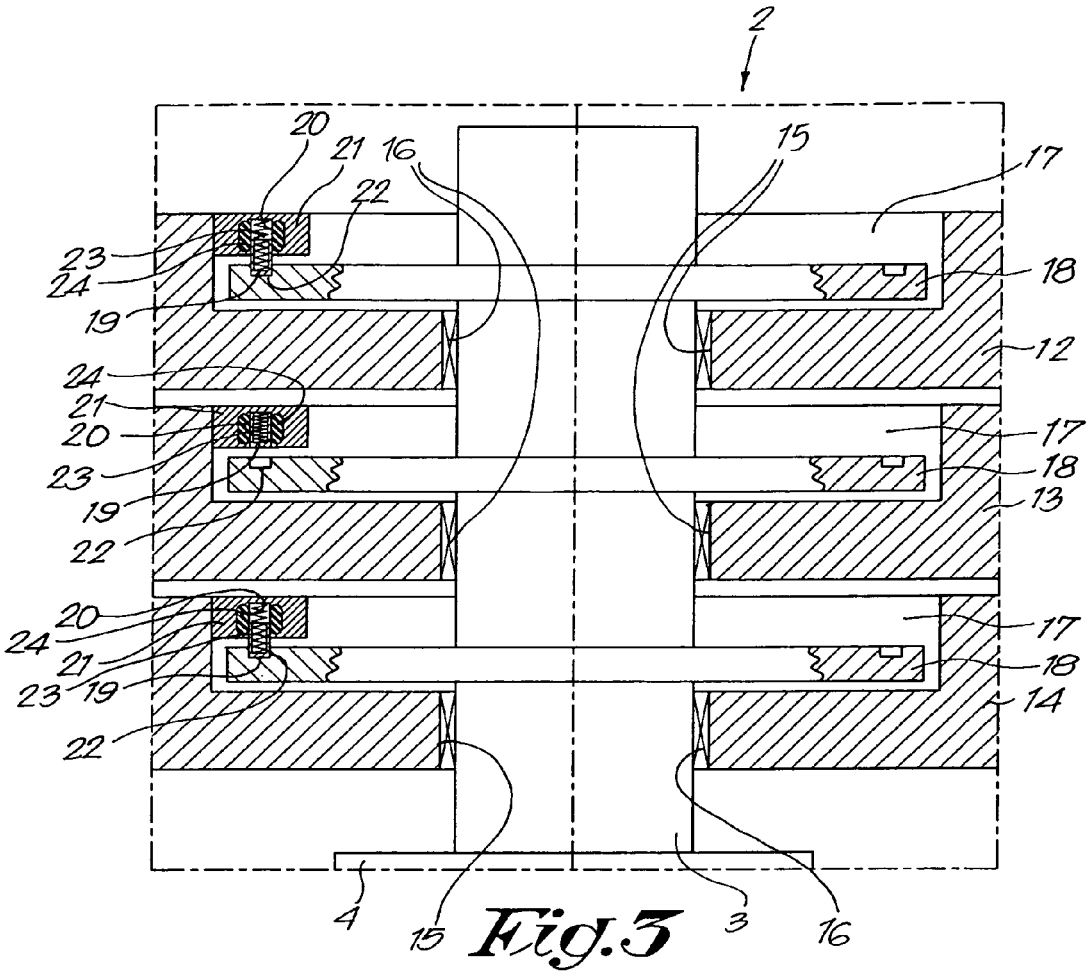
FIG. 3 represents the part which is indicated in FIG. 2 by F3 to a larger scale.

As is represented in greater detail in FIG. 3, these means mainly consist of three drums 12 to 14, each with a central passage 15, which are provided on the above-mentioned shaft 3 by means of bearing bushes 16, whereby, on the perimeter of each drum 12-14, is each time fixed one of the above-mentioned brush holders 9-11.

Further, each of the drums 12-14, in this case, has a central level 17, and locking means are provided between each drum 12-14 and the rotating shaft 3, which make it possible to either or not lock the different drums independently from each other on the shaft 3.

These locking means in this case consist of coupling flanges 18 which are provided in a fixed manner on the shaft 3 and in the floor 17 in the drums 12-14, whereby between each drum 12-14 and the coupling flange 18 concerned, are provided coupling elements.

These coupling elements mainly consist of three locking pins 19 which are each provided such that they can shift in an axially directed bore 20 in a protrusion 21 on each of the drums 12-14, and of four corresponding fitted holes 22 per coupling flange 18, which holes are situated at a same distance from the shaft 3 as the locking pin 19 in the corresponding drum 12-14.

The above-mentioned locking pins 19 are provided with control elements to shift the locking pins 19 co-axially in their bore 20 concerned, which control elements each time consist of a spring 23 provided in the bore 20 concerned and of an electromagnetic coil 24 provided along the perimeter of the bore 20 in the above-mentioned protrusion 21 and which is connected to an appropriate electric circuit which is not represented in the figures, whereby the locking pins 19 are made of a ferromagnetic material.

Every brush holder 9-11 is in this case provided with locking means which make it possible to lock the brush holders 9-11 in a position opposite the above-mentioned posts 5-8.

These locking means may for example be embodied in the form of a hole 25 in each of the brush holders 9-11 and of a protrusion 26 fitting in the hole 25, which can be moved in relation to the brush holders 9-11 and which is provided to this end for example at each of the working posts 7-8, which are provided with a tool, which tools, as is known, can be radially moved in relation to the shaft 3 of the carrousel 2.

The working of a device according to the invention for manufacturing brushes is simple and as follows.

For manufacturing brushes, a brush body 27 to be processed is first loaded on the brush holder 9, situated opposite the loading and unloading tool 6.

As this operation can in most cases be realized faster than providing holes in the brush bodies 27 with the help of the above-mentioned drilling tool, provided in the working post 7, and than filling the holes with bundles of fibers 28 in the working post 8, after a brush body 27 has been loaded, the brush holder 9 concerned is rotated opposite the waiting post 5, where this brush holder is maintained in a wait position, whereas the other brush holders 10-11 remain locked in relation to the working post 7-8 concerned respectively.

This rotation of the brush holder 9 is, in this case, obtained by locking the drum 13 concerned in relation to the coupling flange 18 concerned, by electrically deactivating the above-mentioned coil 24, as a result of which the locking pin 19 concerned is moved by the spring 23 concerned into the corresponding fitted hole 22 in the coupling flange 18 concerned.

When, subsequently, the brush bodies 27 in the brush holders 10-11 have undergone their respective operations, all the brush holders 9-11 are rotated at an angle of 90°, as a result of which the brush holder 9 is moved from opposite the waiting post 6 to opposite the working post 7.

Once it is in position, the drive of the shaft 3 is stopped, and the brush holder 9 is locked in relation to the shaft 3 of the carrousel 2, by activating the electric coil 24 in the drum 13, as a result of which the locking pin 19 concerned is moved, against the action of the spring 24, from the fitted hole 22 into the bore 20.

The brush holder 9 is locked in relation to the drilling tool in the working post 7, by moving this drilling tool to the brush holder 9, whereby the protrusion 26 is moved into the hole 25, such that the brush holder 9 can no longer rotate around the carrousel 2.

Next, holes for the fibers of the brush are drilled in the known manner in the brush body 27 concerned, after which the drilling tool is withdrawn, so that the brush holder 9 is unlocked in relation to the working post 7 concerned and the brush holder 9 can thus be rotated further opposite the following working post 8.

While the above-mentioned holes are being made, the shaft 3 is rotated at an angle of 90°, whereby one of the other brush holders, more particularly brush holder 11 is moved from opposite the loading and unloading tool 6 to opposite the waiting post 5, as a result of which also the coupling flange 18 is rotated 90° opposite the drum 13, onto which the brush holder 9 is fixed, and whereby a following fitted hole 22 in this coupling flange 18 is positioned opposite the locking pin 19 concerned.

After the holes have been made in the brush body 27, the above-mentioned electric coil 24 is deactivated, such that the drum 13 is locked in relation to the shaft 3, and is rotated with this shaft 3 at an angle of 90° until the brush holder 9 is positioned opposite the working post 8, where, analogous to working post 7, the processing concerned, namely the filling of the holes with bundles fibers 28, takes place.

Finally, the brush holder 9 is rotated further around the shaft 3 opposite the loading and unloading tool 6, where the finished brush body 27 is removed from the brush holder 9 and a new brush body 27 to be processed is loaded in the brush holder 9, after which the above-described cycle starts again.

It should be noted that the locking means can be made in many different manners. Thus, for example, hydraulic or pneumatic cylinders can be used which make it possible to push the drums 12-14 against the coupling flanges 18, whereby opposite sides of these drums 12-14 and coupling lo flanges 18 are preferably made of materials with a high coefficient of friction.

Also the locking means can be made in alternative manners. Thus, the above-mentioned protrusions 26 do not necessarily have to be part of the tools in the working posts 7-8, but they can be provided on a foot which can be moved to and fro and which is fixed in relation to the working floor, which is equipped with a drive of its own, and which is provided on one or several of the above-mentioned posts 5-8.

Further, it should be noted that the device according to the embodiment can be converted relatively fast into a device with a carrousel 2 around which are provided four brush holders 9-11, by applying a second brush holder 9-11 on one of the drums 12-14, more particularly opposite the post 5-8 of the carrousel 2 where there is no brush holder 9-11 for the time being, and by constantly keeping the drums 12-14 in a locked position in relation to the shaft 3 of the carrousel 2.

In this arrangement, four working posts 6-8 can be provided in the described device along the perimeter of the carrousel 2.

Naturally, the present invention can also be applied for a device with a triangular carrousel, whereby, in this case, two drums 9-10 will suffice.

Figure 4:
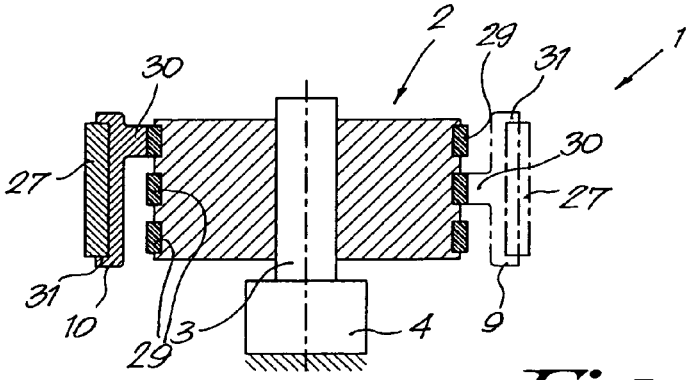
FIG. 4 represents a variant according to FIG. 2.

FIG. 4 represents a variant in which the carrousel 2 consists of a shaft 3, onto which is provided one drum 12 in a fixed manner, and whereby, around this drum 12, preferably three guides 29 are provided in the form of a circumferential groove, in which is each time provided one brush holder 9-11 such that it can freely move along the perimeter of the drum 12, which brush holder 9-11 is in this case held in a shifting manner with a foot part 30 in the above-mentioned grooves, whereas a brush body 27 can be fixed in a head part 31 of each brush holder 9-11.

Also in this variant are provided locking means which are not represented in the figures and which are in this case situated between the brush holders 9-11 and the drum 12 and which make it possible to lock each brush holder 9-11 in relation to the carrousel 2, more particularly in relation to the drum 12.

This variant is preferably equipped with locking means as well, which make it possible to lock each brush holder 9-11 opposite the post 5-8 concerned.

The present invention is by no means limited to the embodiments described above and represented in the accompanying drawings of a device according to the invention for manufacturing brushes; on the contrary, such a device can be made in all shapes and dimensions while still remaining within the scope of the invention.

The invention claimed is:

1. A device for manufacturing brushes by means of successive brush manufacturing operations, comprising a plurality of brush holders disposed on a transport device that is movable between different working stations provided along a path of motion of the transport device, said working stations including either or both processing stations and waiting stations where the brush holders are put in a wait position, said transport device comprising a brush holder movement enabling arrangement enabling movement of the brush holders by the transport device independently from one another; wherein said brush holder movement enabling arrangement comprises a brush holder locking system enabling selective locking of each brush holder opposite one or several of said working stations.

2. The device according to claim 1, wherein said brush holder locking system is arranged to enable individual brush holders to be locked independently from each other.

3. The device according to claim 1, wherein said brush holder movement enabling arrangement comprises a transport locking arrangement enabling locking of the brush holders relative to said transport device.

4. The device according to claim 1, wherein said transport device comprises a chain.

5. The device according to claim 4, said working stations including a plurality of processing stations and at least one waiting station, and wherein the number of brush holders is equal to the total number of processing stations.

6. The device according to claim 5, wherein at least two processing stations and one waiting station are provided along the path of motion of the transport device.

7. The device according to claim 6, wherein the processing stations include a station having a loading and unloading tool and a station having a filling tool.

8. The device according to claim 6, including three processing stations and one waiting station and wherein three brush holders are provided on the transport device.

9. The device according to claim 8, wherein the processing stations comprise a station having a loading and unloading tool; a station having a drilling tool; and a station having a filling tool.

10. The device according to claim 1, wherein said transport device comprises a carrousel.

11. A device for manufacturing brushes by means of successive operations, comprising a plurality of brush holders disposed on a transport device that is movable between different working stations provided along a path of motion of the transport device, said working stations including either or both processing stations and waiting stations where the brush holders are put in a wait position, said transport device comprising a brush holder movement enabling arrangement enabling movement of the brush holders by the transport device independently from one another; wherein said brush holder movement enabling arrangement comprises a transport locking arrangement enabling locking of the brush holders relative to said transport device.

* * * * *